United States Patent [19]

Frano

[11] 4,433,452

[45] Feb. 28, 1984

[54] SELF RETAINED PLASTIC CABLE GUIDE AND DOOR STOP

[76] Inventor: Francis G. Frano, 1925 Brookside La., Hoffman Estates, Ill. 60194

[21] Appl. No.: 334,625

[22] Filed: Dec. 28, 1981

[51] Int. Cl.[3] ..... B65D 55/00; E05F 5/02

[52] U.S. Cl. ..... 16/2; 16/82; 16/DIG. 17

[58] Field of Search ..... 16/2, 82, DIG. 17; 339/44 R, 44 M; 220/335

[56] References Cited

U.S. PATENT DOCUMENTS

| | | | |
|---|---|---|---|
| 1,483,912 | 2/1924 | Rissman | 16/82 |
| 1,485,477 | 3/1924 | Behn | 16/82 |
| 2,608,711 | 9/1952 | Moore | 16/82 |
| 2,895,003 | 7/1959 | Rapata | 16/2 X |
| 2,915,778 | 12/1959 | DeVito | 16/82 |
| 2,962,319 | 11/1960 | North et al. | 16/82 X |
| 3,001,811 | 9/1961 | Erickson | 16/82 X |
| 3,243,206 | 3/1966 | Samer | 16/2 X |
| 3,958,300 | 5/1976 | Tanaka | 16/2 |
| 3,986,228 | 10/1976 | Dowse | 16/2 |

FOREIGN PATENT DOCUMENTS

| | | | |
|---|---|---|---|
| 284166 | 1/1928 | United Kingdom | 16/82 |

*Primary Examiner*—Fred A. Silverberg

*Attorney, Agent, or Firm*—Thomas W. Buckman; John P. O'Brien; Jack R. Halvorsen

[57] ABSTRACT

A one piece lubricious plastic cable guide and door stop for guiding a tensile stressed flexible cable-like member through a work piece aperture and then angularly behind the workpiece. The guide is self-retained in said aperture and includes a latch member for temporarily restraining the cable-like member against the tensile stress inducing device during assembly of the opposite end of the cable-like member with a hinged closure member. It is applicable to devices such as a horizontally hinged dryer door that is spring biased by a pair of said cable-like members and one or more coil springs.

14 Claims, 9 Drawing Figures

Fig. 7
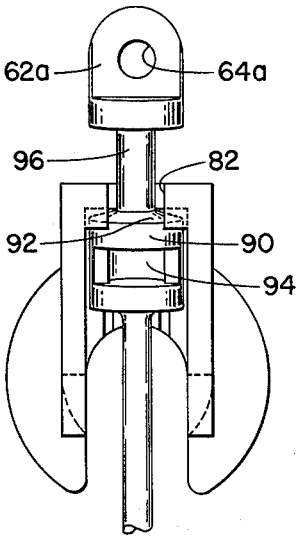
Fig. 6
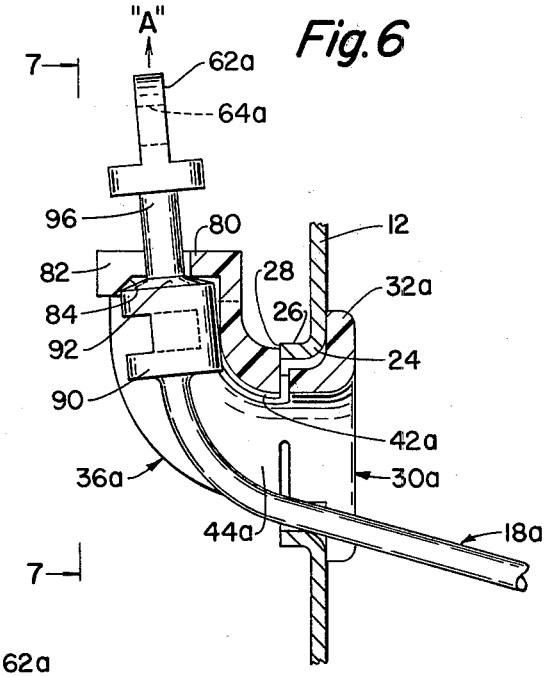
Fig. 8
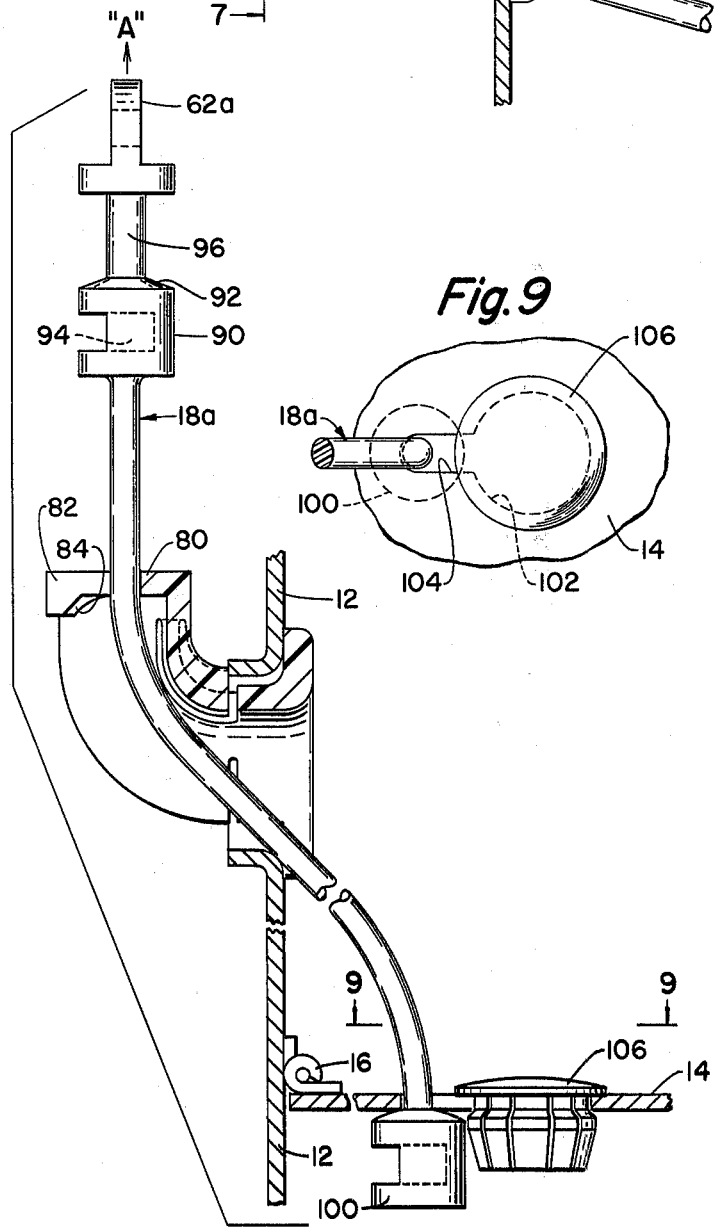
Fig. 9

SELF RETAINED PLASTIC CABLE GUIDE AND DOOR STOP

BACKGROUND OF THE INVENTION

I. Field of Use

The present invention is directed to a device capable of guiding a cable-like member through an apertured panel and then providing a lubricious surface angularly disposed relative to the axis of the aperture. For purposes of displaying at least one workable embodiment of the present invention such a cable guide is shown in the environment of a horizontally hinged dryer door as found in the Appliance Industry.

II. Prior Art

Grommets for lining the raw edge of an aperture can be found in the patents to Johnson U.S. Pat. No. 3,341,885 and Olsen U.S. Pat. No. 3,264,677. Means for angularly routing a wire or cable can be found in the resilient fair-lead in the patent to Clarkson et al. U.S. Pat. No. 2,529,486 or in the wire distributing floor structure in the patent to Wiesmann U.S. Pat. No. 2,665,147. In each of these latter devices as well as the grommets mentioned above it is necessary that the cable be fed through the device from end to end. Right angularly disposed cable guiding means can be found in the right angle strain reliefs shown in the patents to Dowse U.S. Pat. No. 3,986,228 and Tanaka U.S. Pat. No. 3,958,300. While each of these devices shows a right angular disposition of electrical conductors they do not permit free movement of the cable-like member, but rather, are specifically directed to the restraining of that cable-like member by virtue of the abrupt bend therein and the restraining features secondary thereto.

A specific form of cable-like member shown in the present invention and formed totally of an injection molded plastic member can be found in the British specification No. 1,198,617 in the name of Fernberg et al. and assigned to the wholly owned subsidiary of the assignee of the present invention. Such a device includes an elongated central portion with enlarged members molded at opposite ends. After removal of the formed member from the mold the two enlarged portions are gripped and pulled apart to stretch the central portion to a reduced diameter. This induces a particular improved tensile quality to the elongated portion of the article and permits it to serve as a cable-like member for control rods as well as in the tensile biased system found in the principal embodiments of the present invention.

Each of the devices shown in the prior art has limitations which are not compatible with the usage intended for the present invention and hence are not acceptable as substitutes therefore.

SUMMARY OF THE INVENTION

The present invention relates to a one piece plastic cable guide and door stop that can be readily inserted into an apertured workpiece and be self retained. It is open sided so that the cable-like member can be laid into the device and not require feeding in from an end to end position. The device is universal so that there is no need for left or right hand versions and the self retaining eliminates the necessity for secondary fastening means such as screws.

An added advantage of the present invention is to provide means for capturing the cable-like member under tension during assembly to the front hinged door panel. A further object of the present invention is to permit easy assembly to the door per se as well as to provide a door stop in both the open and closed positions. A further object of the present invention is to provide a device which is economical to fabricate and easy to install during the assembly operation.

Other objects will be apparent to those skilled in the art.

BRIEF DESCRIPTION OF THE DRAWINGS

FIG. 6 is an elevational view in section showing a second embodiment of the present invention in installed position;

FIG. 7 is a rear view of the second embodiment showing the cable-like member in locked position as taken along line 7—7 of FIG. 6;

FIG. 8 is an expanded elevational view in section of the various elements of the present invention as installed in the fragmentary portions of a dryer front panel and door of the type shown in FIGS. 1–2;

FIG. 9 is a partial plan view taken along line 9—9 of FIG. 8.

DETAILED DESCRIPTION

Figure 1:
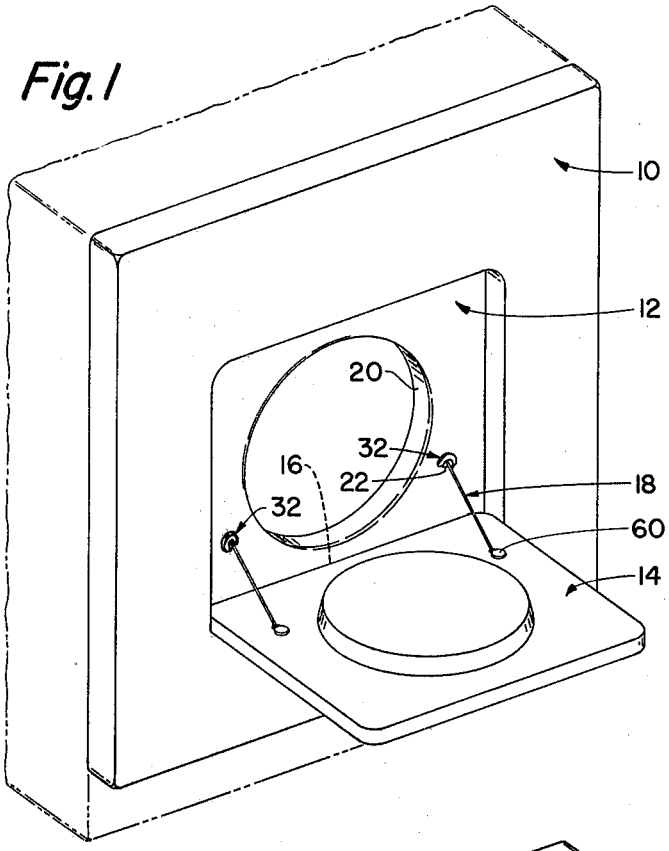
FIG. 1 is a perspective frontal view of the front panel of a horizontal hinged dryer door showing the body of the dryer in phantom.

Referring now to the drawings wherein similar parts are designated by similar numerals, a plastic cable guide of the type envisaged by the present invention can, by way of example and not by way of limitation, be utilized in the front panel 10 of a dryer. Such a panel 10 includes a recess 12 for acceptance of a door 14 horizontally hinged along one edge 16. The door is supported in its open position by one or more cable-like members 18 passing through apertures on opposite sides of the central opening 20 which normally accepts the clothing being inserted into the dryer appliance. As best seen in FIG. 6 the apertures 22 in the recess portion 12 are drawn to provide a smooth front corner 24 and a rearwardly extending tubular portion 26 terminating in a rim 28.

Figure 3:
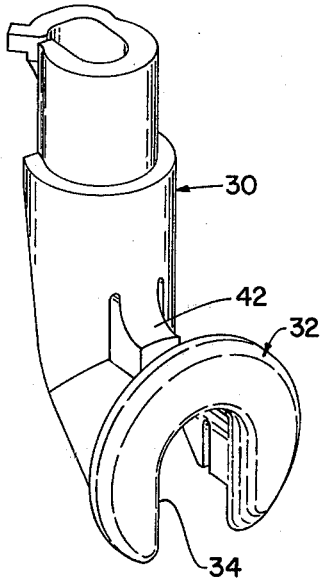
FIG. 3 is a perspective view of one embodiment of the present invention and taken from the head end.
Figure 4:
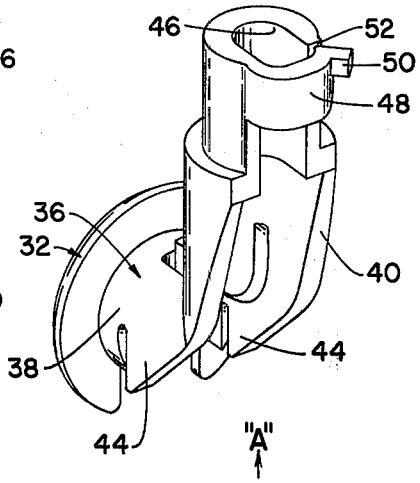
FIG.4 is a perspective view of the same embodiment as viewed from the rear.

Inserted within the aperture 22 is a one piece self retaining plastic cable guide 30 of the type contemplated by the present invention and with the first embodiment thereof being shown in FIGS. 3-4. Such a guide 30 includes a head 32 having a central aperture 34 that extends and opens through the lower edge thereof. A body portion 36 in the form of a generally L-shaped open channel 36 which is generally an inverted U-shape in cross section includes a first portion 38 coaxially disposed relative to the head 32 and a second portion 40 that is substantially perpendicular to the axis of first portion 38 and blended together by a curved intermediate portion. Spaced from the back side of head 32 and extending out of the bight of the U-shaped channel is a resilient tab 42. The sides of the leg or free edges of the U-shaped channel can be slotted to provide a pair of resilient fingers 44 in similar spaced relation to the back of head 32. Thus, the guide 30 can be laced into the aperture 22 until the head 32 rests on the front of the recess 12 with the resilient tab 42 and the resilient fingers 44 collapse inwardly when inserted through the aperture 22 until they pass the end 28 of the extruded tubular portion 26 when they will spring out and engage the rear side thereof to thereby self retain and lock the present invention in mounted relation. At the upper extremity of the upper portion 40 there is provided a restricted opening 46 and a resilient closer 48 having tab means 50 forming a restricted slot 52. Actuation of the tab means 50 will open the slot 52 to premit the cable-like member 18 to be laid into the open channel configuration of the guide 30 and still serve to restrain the positioning of the cable 18 therein.

Figure 2:
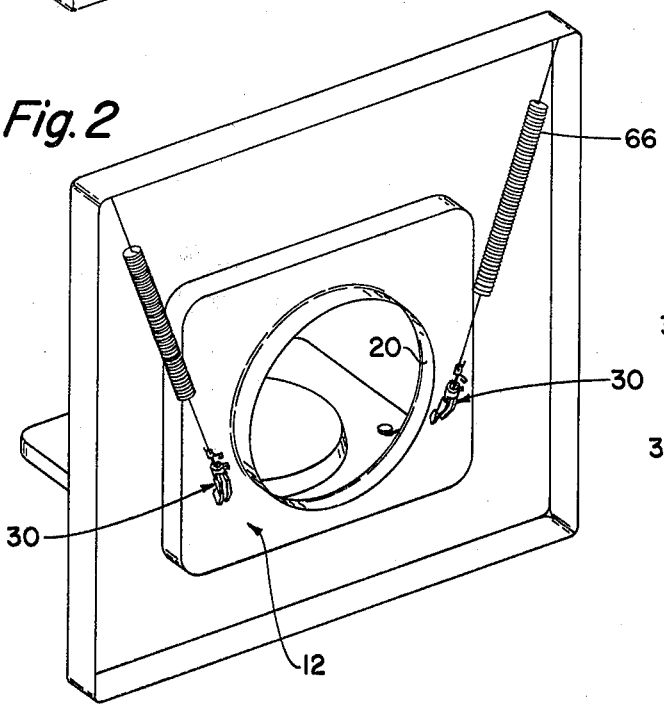
FIG. 2 is a rear view of the front panel showing the disposition of one embodiment of the present invention.
Figure 5:
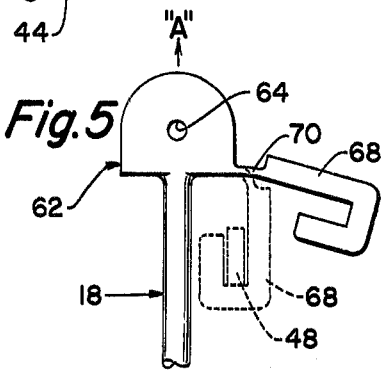
FIG. 5 is a fragmentary view of one end of a cable-like member used with the embodiment shown in FIGS. 1–4 in showing the tension locking means in phantom position.

The cable-like member 18 which supports the door 15, in the present invention is contemplated to be an elongated filament of stretched plastic material which is fastened at its outer extremity 60 to the inner face of the door 14, as will be described in more detail hereinafter, and in the present embodiment is provided at its opposite end by an enlarged head 62 with a central bore 64 for attachement to a tensioning spring 66 fastened at its opposite end by suitable means, not shown, to the inside surface of the front panel 10. The enlarged head 62 includes a hook 68 connected to the head 62 by a resilient spring like hinge 70. As part of the assembly procedure it has been found desirable to permit the end 60 to be assembled to the door 14 without the force of spring 66 acting on the cable-like member 18. This can be accomplished by engaging hook 68 under the closure member 48 to thereby counteract the force of spring 66, as represented by the arrow "A" in FIG. 5, and thereby allow the cable-like member 18 to be applied without stress to the door 14. When this assembly to door 14 has been accomplished a simple force on cable-like member 18 in a direction opposite to the arrow "A," as seen in FIG. 5, will result in the hook 68 moving laterally by resilient hinge 70 and thereby effectuating application of the tension by spring 66 against the door. The head 62 will contact the upper free end of upper portion 40 to prevent downward motion of the door 14. The force of the spring 66 is generally controlled so that the weight of the door 14 will normally permit it to remain in its horizontal position, as generally shown in FIGS. 1–2, however, mere finger pressure against the door to overcome its weight will permit this spring 66 through the cable-like member 18 to move the door into a closed position within the recess 12. In the closed position head 32 serves as a bumper and stop.

Referring now to FIGS. 6–9, wherein similar parts are designated by similar numerals with the addition of the suffix "a", the cable guide **30*a* includes a head portion 32*a*; an inverted U-shaped body portion 36*a* that has resilient tabs 42*a* and split arm portions 44*a* for engaging behind the rear edge 28, substantially identical to the first embodiment. In this present embodiment the open channel is closed by a restricted end portion 80 having a slot 82 that opens in the same direction as the body 36*a*. The surface of end closure 80 generally is restricted by a shoulder 84 to give enclosure 80 a generally concave configuration. In this embodiment the cable-like member 18*a* includes an enlarged head 90 having a convex free end 92 generally complementary to the shoulder 84 and the undersurface of closure 80. Head 90 can be recessed as shown at 94 for fabrication as well as to ensure final form, as is well known in the molding art. Extending upwardly from enlarged head 90 at its upper convex surface 92 is extension 96 terminating in a second head 62*a* having a central aperture 64*a* for engagement by suitable spring means such as the compression spring 66. To assist in the assembly operation, in this embodiment, the enlarged head 92 is positioned within the channel portion, as best seen in FIGS. 6–7 and with the extension 96 disposed within the slot 82 thereby restraining cable-like member 18*a* against the force "A" of spring means 66. With the cable-like member 18*a* being in a non-tensile stressed condition the enlarged end 100, as best seen in FIGS. 8–9, at the opposite end of cable-like member 18 can be inserted into a key hole slotted aperture 102 and thence moved laterally so that the cable-like member 18 resides within the slotted portion 104 of the aperture. To ensure that the member 100 does not, as a result of the natural resiliency of the cable-like member 18 become disengaged a hole plug 106 of generally known design can be inserted into the enlarged portion 102, as best seen in FIGS. 8–9. After this assembly of the enlarged head 100 is accomplished relative to the door 14 an axial pull on cable-like member 18*a*, against the force "A," will result in the enlarged head 92 moving laterally, to the left as viewed in the drawings, and thence permit the cable-like member 18*a* to move into the slot 82** for further operation of the door as planned.

Thus, two embodiments of the present invention have been disclosed each of which utilizes the same head style and retaining means relative to the front recess portion 12 of the panel 10 but with different forms of restraining means to retain the upper end of the cable-like member 18 relative to the upper end of the cable guide 30. The manner in which the cable-like member 18 and **18*a* are affixed relative to the door 14 are interchangeable between these two embodiments and are merely an example of a workable means for such association. Similarly while a tensile spring 66** has been shown as the motivating force it will be appreciated that other means such as hydraulics or other stress inducing means can be equally well substituted at the will of the designer. What has been disclosed is a simple economical self retained element that will provide a lubricious passageway for accommodating with ease of assembly a cable-like member. While a pre-stressed plastic monofilament has been shown it will be appreciated that twisted or single strand wire cable could also be utilized with appropriate terminations at opposite ends. Other modifications will be apparent to those skilled in the art.

I claim:

1. The combination of a cable-like member and a one-piece cable guide and door stop which is mounted in an aperture of a workpiece, said cable-like member having an enlarged end on one end thereof with a force inducing means reacting to place a tensile stress on said member through said enlarged end and having means on its other end for connecting to a movable member, said one-piece cable guide and door stop comprising enlarged apertured head means, channel means integral with said head means which extends coaxially therefrom and angularly relative thereto, said one-piece cable guide and door stop having means for engaging said workpiece on a surface opposite the surface engaged by said head means, said head means and said channel means having a generally inverted U-shaped cross section and having an opening through adjacent edges thereof to permit entry of said cable-like member, said channel means being slotted at a point diametrically opposite said adjacent edges to provide a resilient shouldered tab spaced from said head means for engaging said workpiece, and means located on said channel means for cooperation with said enlarged end to at least temporarily overcome said tensile stress in said cable-like member.

2. A combination of the type claimed in claim 1 wherein said U-shaped channel adjacent its end opposite said head means includes means for substantially closing an open mouth of said opposite end of said channel and cooperating with said enlarged end.

3. A combination of the type claimed in claim 2 wherein said channel is provided with a slotted end closure at the end opposite said head, said slot opening through an edge of said end closure in the same direction as the opening of said U-shaped channel, said enlarged end being removeably acceptable within said channel and in abutment with said end closure to restrain said cable-like member against said tensile stress created by said force inducing means.

4. A combination of the type claimed in claim 3 wherein said enlarged end includes two interconnected portions, the first portion connected to said cable-like member and having means for cooperatively engaging said end closure, an intermediate connecting means extending axially from said first portion and traversing said slot in said end closure, and a second portion connected thereto for association with said force inducing means.

5. A combination of the type claimed in claim 4 wherein said first portion includes a convex surface nestable within a concavity in said end closure, said first portion disengagable by movement laterally out of said channel member while said intermediate means is moved out of said slot and both are thence moved to the opposite side of said end closure with said cable-like member then disposed for free axial movement within said slot and said channel member.

6. A combination of the type claimed in claim 5 wherein said workpiece is a vertically disposed apertured workpiece, said movable member being a horizontally hinged closure member with said force inducing means adapted to control relative position of said closure member dependent upon its angular disposition.

7. A combination of the type claimed in claim 6 wherein said fastening means at the opposite end of said cable means is an enlarged head accepted within the enlarged portion of a keyhole slot in said closure and then shifted to underlie a narrow slot accepting said cable-like member.

8. A combination of the type claimed in claim 7 wherein there are two of said guides and said cable-like members, said cable-like members each being a flexible mono-filament member having its enlarged ends integrally molded thereon.

9. A combination of the type claimed in claim 2 wherein said means for substantially closing said U-shaped channel includes an integral moveable element that substantially bridges a span between free ends of said U-shaped channel along a limited portion of their axial extent, said enlarged means further includes a moveable hook member that is adapted to engage said element and remain engaged while under said tensile stress and to disengage from said element upon release of said tensile stress.

10. A combination of the type claimed in claim 9 wherein said hook member is connected to said enlarged end by a resilient hinge normally biased to a laterally extending hook disengaged position, whereby release of said hook is accomplished by pulling on said cable-like member until said hook is below said element and said hinge springs laterally outwardly carrying said hook out of engaging position.

11. A combination of the type claimed in claim 9 wherein said workpiece is a vertically disposed apertured workpiece, said movable member being a horizontally hinged closure member with said force inducing means adapted to control relative positionment of said closure member dependent upon its angular disposition.

12. A combination of the type claimed in claim 11 wherein said fastening means at the opposite end of said cable means is an enlarged head accepted within the enlarged portion of a keyhole slot in said closure and then shifted to underlie a narrow slot accepting said cable-like member.

13. A combination of the type claimed in claim 12 wherein there are two of said guides and said cable-like members, said cable-like members each being a flexible mono-filament member having its enlarged ends integrally molded thereon.

14. A combination of the types claimed in either claim 8 or claim 13 wherein said head of each of said cable guides has an enlarged thickness and serves as a bumper to substantially prevent contact between said workpiece and said closure member when in juxtaposed relation.

* * * * *